US011633837B2

(12) United States Patent
Lenart

(10) Patent No.: US 11,633,837 B2
(45) Date of Patent: Apr. 25, 2023

(54) RETROFITTABLE AUXILIARY PLIERS HANDLE ASSEMBLY

(71) Applicant: Edward Lenart, Farmington Hills, MI (US)

(72) Inventor: Edward Lenart, Farmington Hills, MI (US)

( * ) Notice: Subject to any disclaimer, the term of this patent is extended or adjusted under 35 U.S.C. 154(b) by 314 days.

(21) Appl. No.: 17/060,547

(22) Filed: Oct. 1, 2020

(65) Prior Publication Data

US 2022/0105607 A1 Apr. 7, 2022

(51) Int. Cl.

| | |
|---|---|
| ***B25B 7/12*** | (2006.01) |
| ***B25B 7/22*** | (2006.01) |
| ***B25B 7/08*** | (2006.01) |
| *B25B 7/02* | (2006.01) |

(52) U.S. Cl.

CPC ..... *B25B 7/12* (2013.01); *B25B 7/08* (2013.01); *B25B 7/22* (2013.01); *B25B 7/02* (2013.01)

(58) Field of Classification Search

CPC .... B25B 7/00; B25B 7/02; B25B 7/06; B25B 7/08; B25B 7/12; B25B 7/14; B25B 7/16; B25B 7/18; B25B 7/22; B25B 31/00; B25B 33/00; B25B 9/00; B21D 39/025

See application file for complete search history.

(56) References Cited

U.S. PATENT DOCUMENTS

| | | | | |
|---|---|---|---|---|
| 3,969,964 A * | 7/1976 | George | B25B 7/00 29/268 |
| 4,028,971 A * | 6/1977 | Budrose | B25B 7/12 30/191 |
| D368,631 S * | 4/1996 | Swierczynski | D8/4 |
| 2020/0282524 A1* | 9/2020 | Soli | B25B 7/14 |

* cited by examiner

*Primary Examiner* — Robert J Scruggs

(57) ABSTRACT

A retrofittable auxiliary pliers handle assembly includes a coupler removably coupled to a grip of a pair of pliers. The coupler is positionable between a free end of the grip and a pivot of the pliers. The coupler includes a receiver positioned laterally away from an exterior lateral surface of the grip. An auxiliary handle is positioned in the receiver such that the auxiliary handle is positioned adjacent to the exterior lateral surface and extends away from the pivot. A finger space is defined between the auxiliary handle and the grip. The auxiliary handle comprises a plate that elongated and has a first end, a second end, a first lateral side, a second lateral side, an upper edge and a lower edge. The coupler engages the plate adjacent to the first end such that the first lateral side faces the exterior lateral surface.

8 Claims, 5 Drawing Sheets

RETROFITTABLE AUXILIARY PLIERS HANDLE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to pliers actuating device and more particularly pertains to a new pliers actuating device for attachment to pliers' grips to facilitate the opening of the jaws of fine-movement pliers.

(2) Description of Related Art Including Information Disclosed Under 37 CFR 1.97 and 1.98

The prior art relates to pliers in general and more specifically wire cutter and manipulation pliers. Some of these pliers, such as dual pivot pliers are elongated and are sometimes difficult to open the jaw without moving one's fingers, such as the index finger, between the grips to try to push them apart. Thus the need exists for a structure to facilitate the opening of pliers and specifically a structure that may be retrofitted to existing pliers.

BRIEF SUMMARY OF THE INVENTION

An embodiment of the disclosure meets the needs presented above by generally comprising a coupler removably coupled to a grip of a pair of pliers. The coupler is positionable between a free end of the grip and a pivot of the pliers. The coupler includes a receiver positioned laterally away from an exterior lateral surface of the grip. An auxiliary handle is positioned in the receiver such that the auxiliary handle is positioned adjacent to the exterior lateral surface and extends away from the pivot. A finger space is defined between the auxiliary handle and the grip. The auxiliary handle comprises a plate that elongated and has a first end, a second end, a first lateral side, a second lateral side, an upper edge and a lower edge. The coupler engages the plate adjacent to the first end such that the first lateral side faces the exterior lateral surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
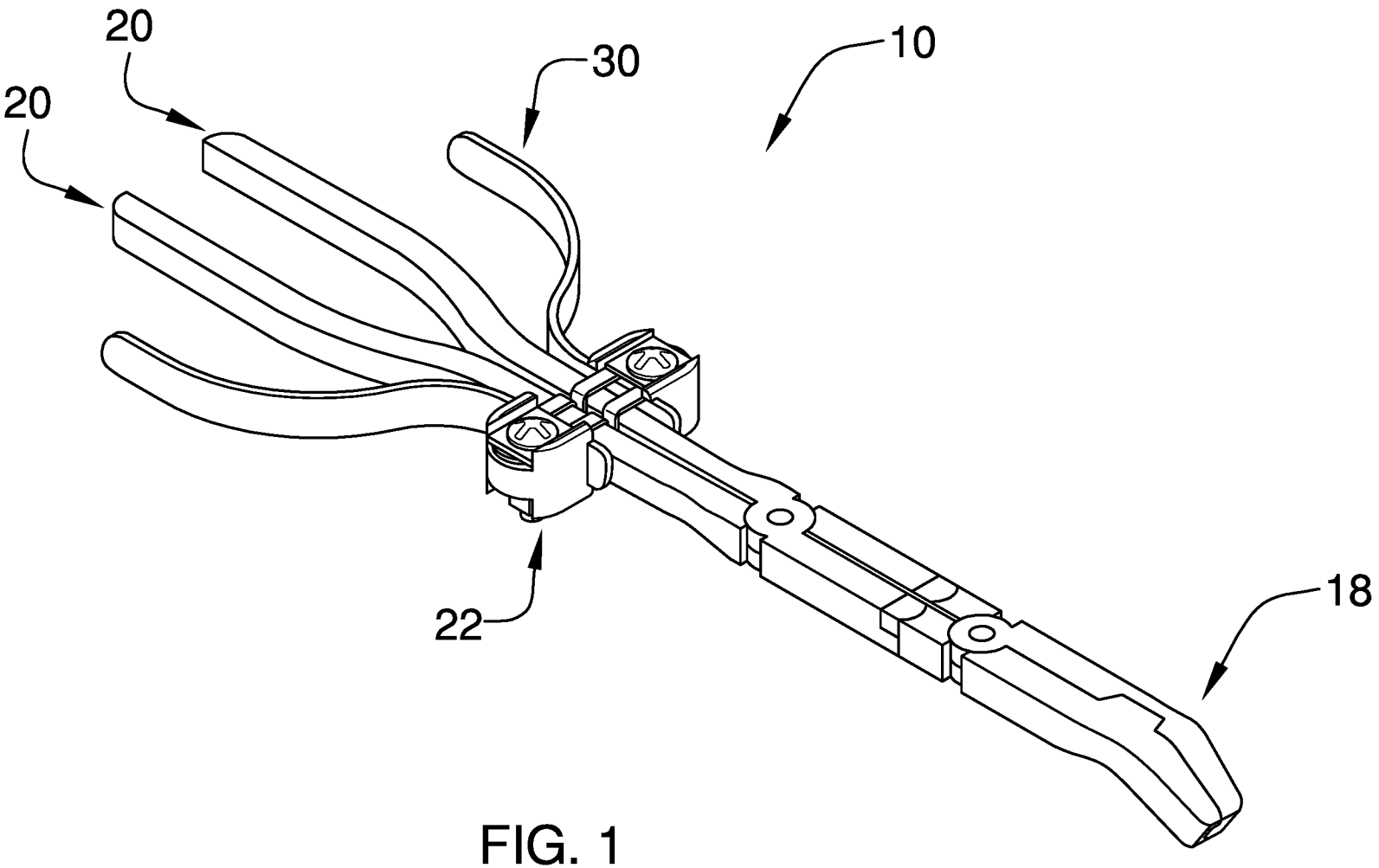
FIG. 1 is a top isometric view of a retrofittable auxiliary pliers handle assembly according to an embodiment of the disclosure.

With reference now to the drawings, and in particular to FIGS. 1 through 7 thereof, a new pliers actuating device embodying the principles and concepts of an embodiment of the disclosure and generally designated by the reference numeral 10 will be described.

As best illustrated in FIGS. 1 through 7, the retrofittable auxiliary pliers handle assembly 10 generally comprises a device that is used with a conventional pair of pliers 12. However, the pliers 12 may comprise dual pivot pliers, sometimes known as compound pliers, including a first joint 14 and a second joint 16 acting in concert with each other to allow fine movements of the jaws of the head 18 while having an elongated structure. Such pliers are particularly useful for wire-cutting type and wire manipulating tasks. The assembly 10 is removably attachable to the pliers 12. As is clearly shown in the Figures, the assembly 10 may be provided as a pair of assemblies wherein each grip 20 of the pliers includes one of the assemblies 10.

The assembly 10 generally comprises a coupler 22 configured to be removably coupled to the grip 20 of the pair of pliers 12. The coupler 22 is positionable between a free end 24 of the grip and a pivot, or the first pivot 14, of the pliers 12. The coupler 22 includes a receiver 26 positioned laterally away from an exterior lateral surface 28 of the grip 20. That is the receiver 26 is extends outwardly lateral away from the grip 20 such that the receiver 26 is not positioned between the two grips 20 of the pliers 12.

Figure 2:
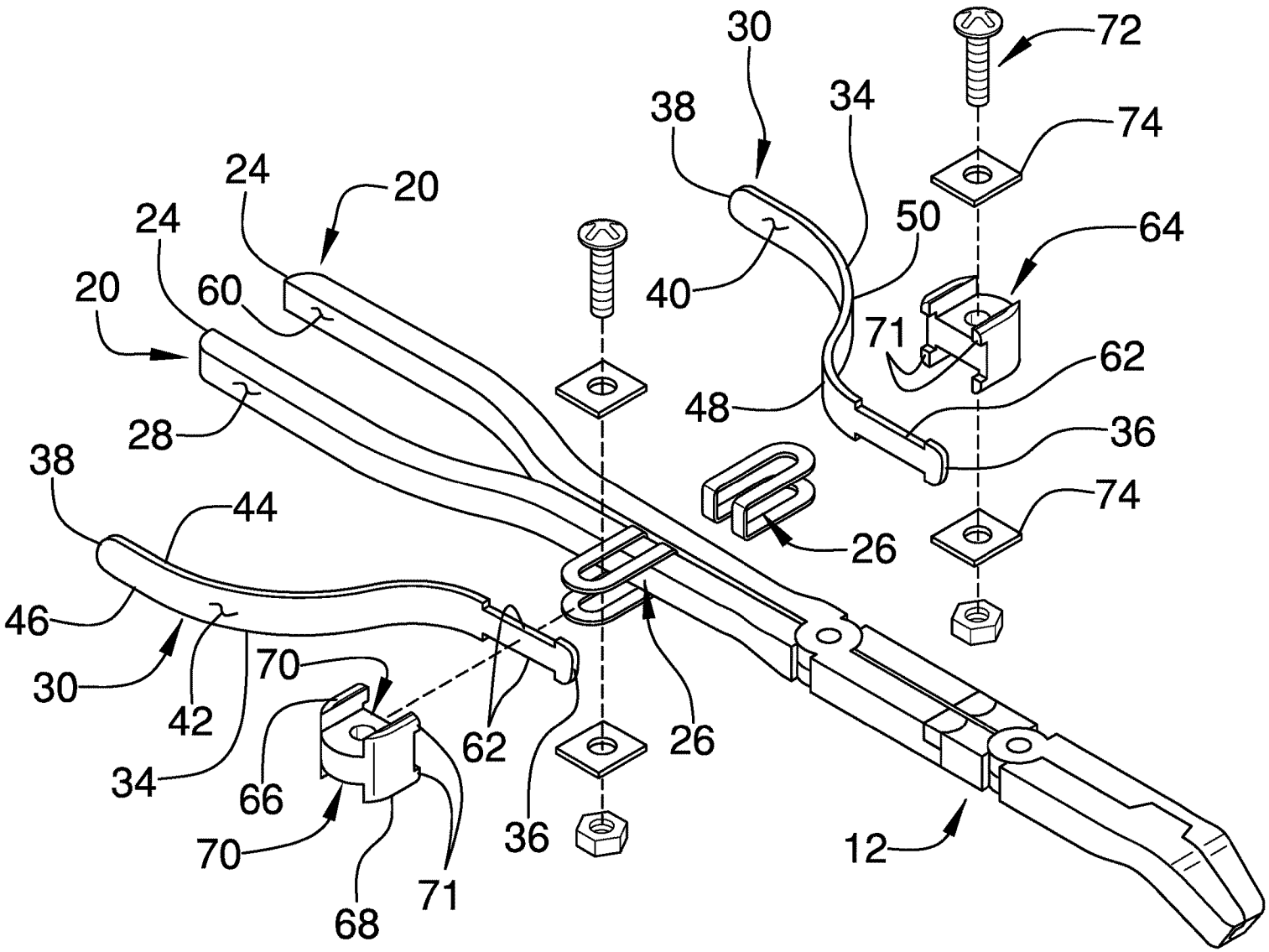
FIG. 2 is an exploded top isometric view of an embodiment of the disclosure.
Figure 3:
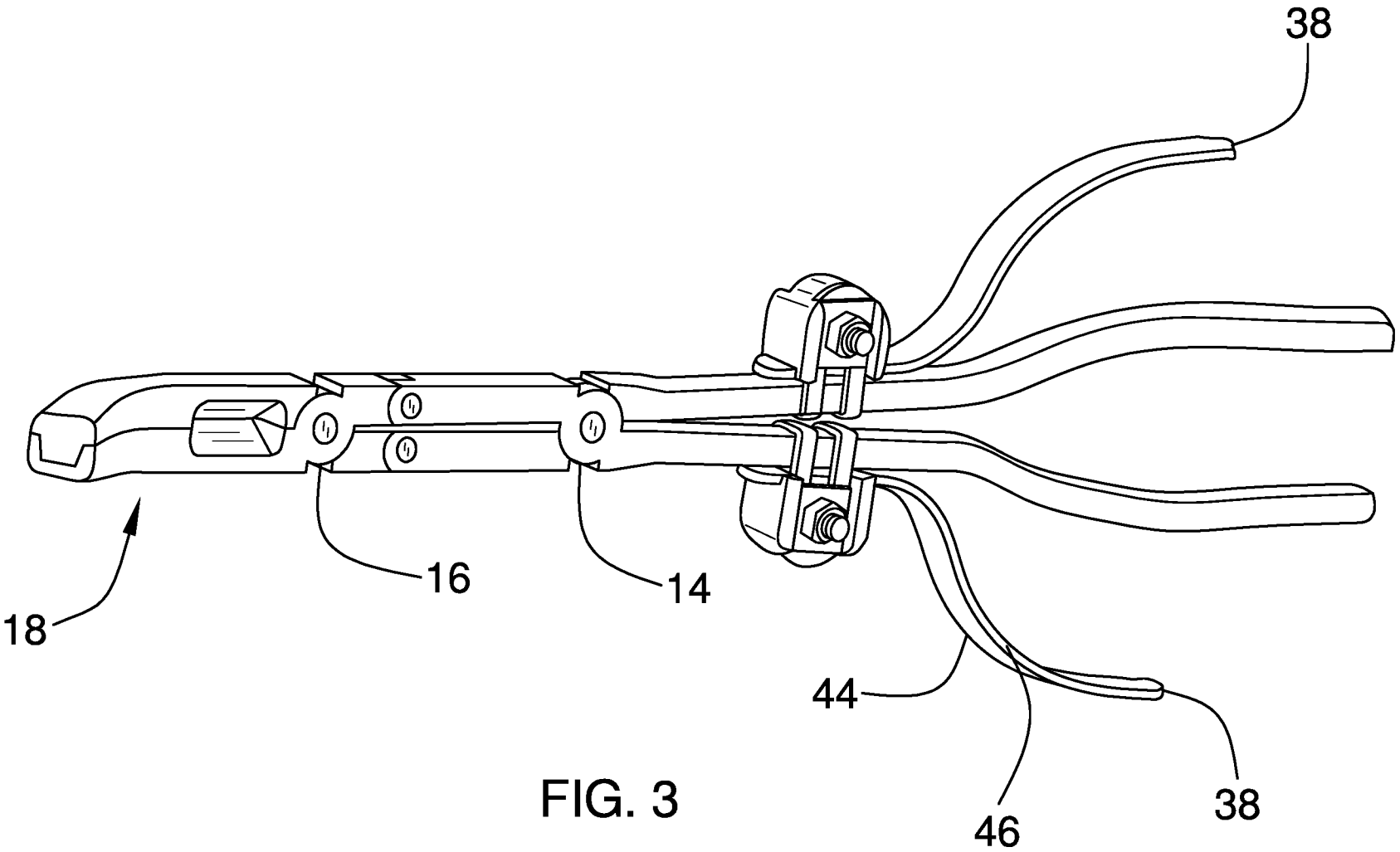
FIG. 3 is a bottom isometric view of an embodiment of the disclosure.
Figure 4:
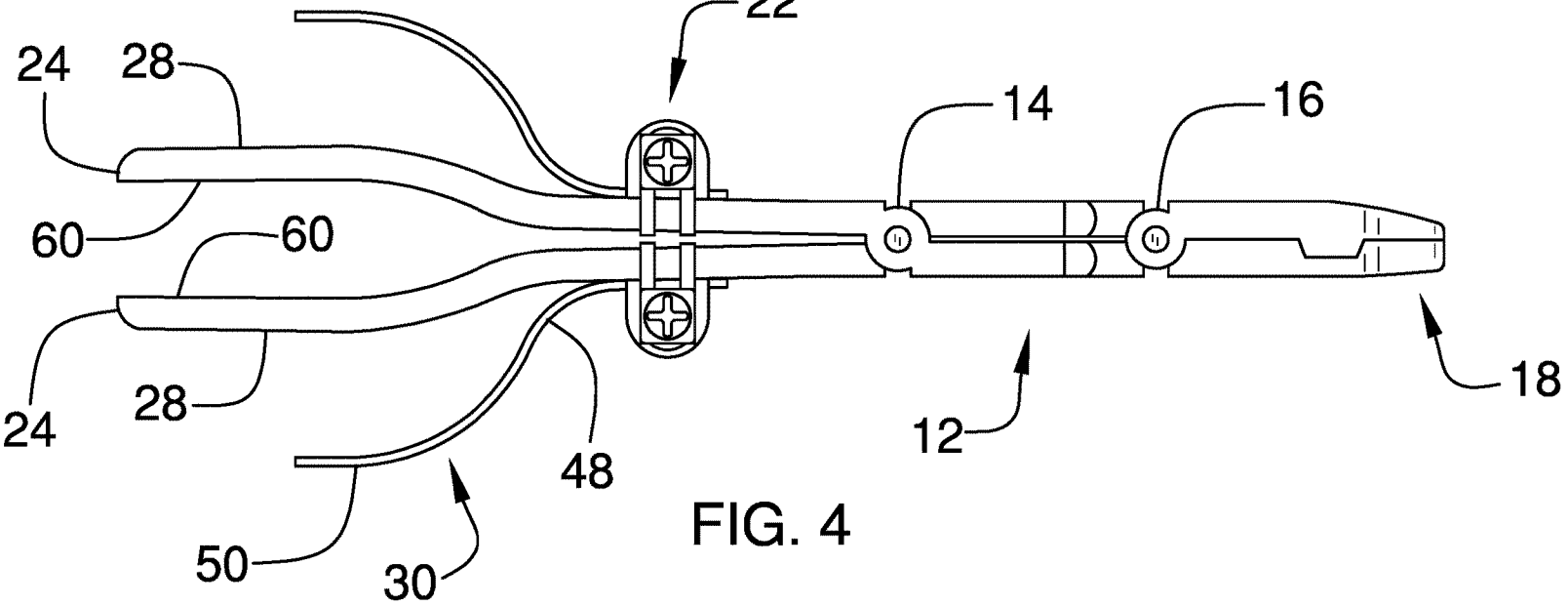
FIG. 4 is a top view of an embodiment of the disclosure.
Figure 5:
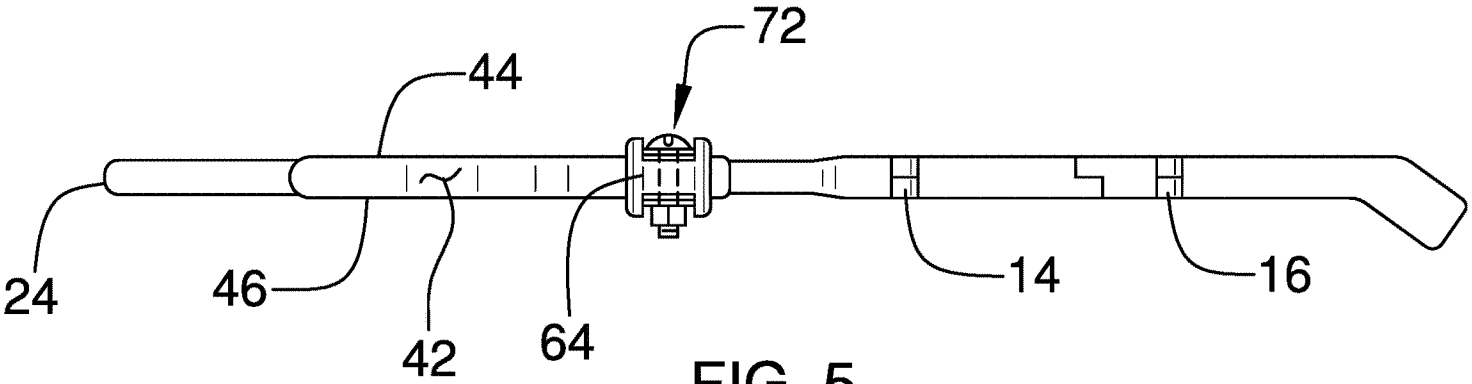
FIG. 5 is a side view of an embodiment of the disclosure.
Figure 6:
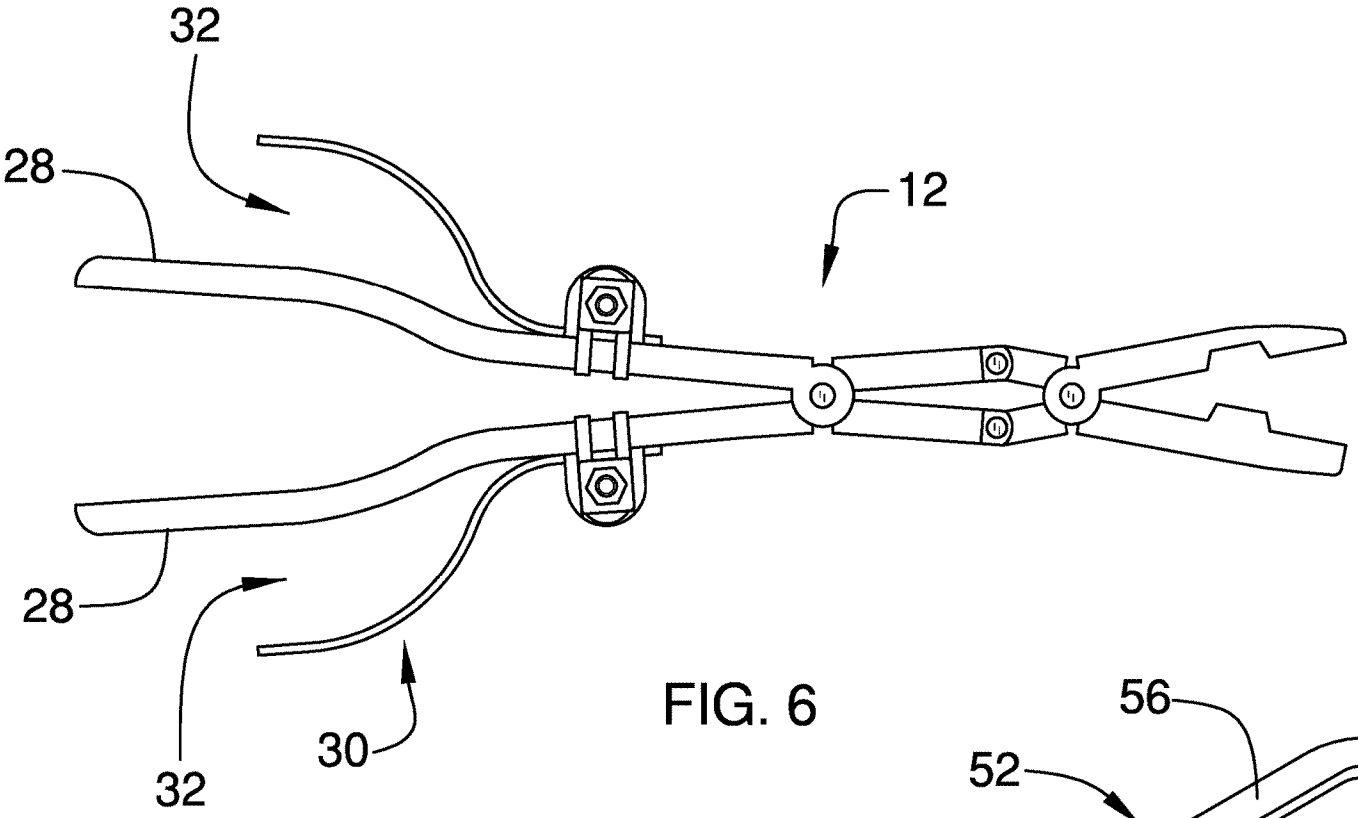
FIG. 6 is a top view of an embodiment of the disclosure.

An auxiliary handle 30 is positioned in the receiver 26 such that the auxiliary handle 30 is positioned adjacent to the exterior lateral surface 28 and extends away from the pivot 14. The auxiliary handle 30 is fixed in relation to the grip 20 by the coupler 22 such that auxiliary handle 30 moves with the grip 20. A finger space 32 is defined between the auxiliary handle 30 and the grip 20. As best shown in FIG. 2, the auxiliary handle 30 comprises a plate 34 that is elongated and has a first end 36, a second end 38, a first lateral side 40, a second lateral side 42, an upper edge 44 and a lower edge 46. The coupler 22 engages the plate 34 adjacent to the first end 36 such that the first lateral side 40 faces the exterior lateral surface 28. The first lateral side 40 has a first bend 48 and a second bend 50 positioned therein. The bends 48, 50 may be sharp bends or arcuate bends, though arcuate bends may facilitate comfort while utilizing the assembly 10. The first bend 48 is nearer to the first end 36 than the second end 38, wherein the first bend 48 forms a convex curve in the first lateral side 40 and the second bend 50 forms a concave curve in the first lateral side 40. A radius of the first bend 48 may be smaller than a radius of the second bend 50 such that an outer, free section of the plate 34 distal to the coupler 22 is adequately spaced from the grip 20 to create the finger space 32.

Figure 7:
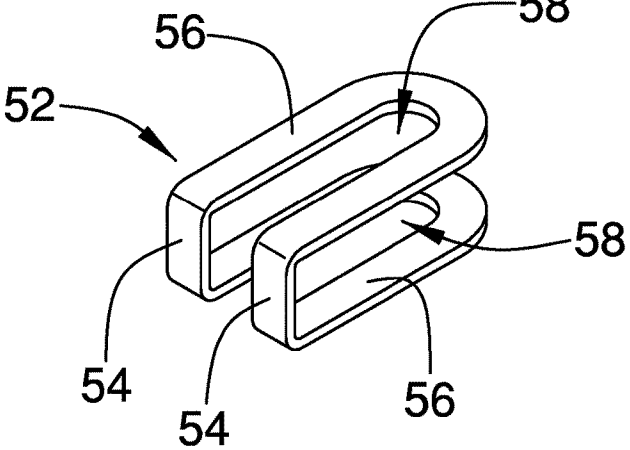
FIG. 7 is a top isometric, enlarged view of a saddle of the disclosure.

The coupler 22 further comprises a saddle 52 shown in FIG. 7 and having a base 54 and a pair of panels 56 that are attached to the base 54 and extend away from the base 54 in same direction with respect to each other. The receiving space 26 is defined between the panels 56. As can be seen in FIG. 2, the panels 56 have openings 58 therein which may be elongated. The base 54 is abuttable against an interior surface 60 of the grip 20 such that the panels 56 extend around the grip 20 and laterally away from the exterior lateral surface 28 of the grip 20. The auxiliary handle 30 is positioned between the panels 56 in the receiving space 26. The upper 44 and lower 46 edges each have a notch 62 therein positioned adjacent to the first end 36. Each of the notches 62 receives one of the panels 56. The notches 62 in the auxiliary handle 30 stabilize the plate 34 relative to the saddle 52.

A stop 64 has a top side 66 and a bottom side 68. Each of the top 66 and bottom 68 sides has slots 70 therein. The stop 64 is positioned in the receiving space 26 and is abutted against the auxiliary handle 30. Each of the slots 70 receives one of the panels 56 to prevent the stop 64 from rotating relative to the saddle 52. A fastener 72 extends through the panels 56 and the stop 64 to retain the stop 64 in the receiving space 26. The fastener 72 may include a threaded screw and nut combination. Rectangular washers 74 may be positioned on the panels 56 and within the slots 70.

In use, the assembly 10, or a pair of the assemblies 10, is attached to pliers 12 as stated above and as shown in the Figures. Once attached to the pliers 12, the auxiliary handle 30 can be used to assist a person in actuating the pliers 30, and, in particular, with opening the pliers 30. The assembly 10 is retrofittable to any pair of pliers 12 and can be removed should the assembly 10 interfere with pliers 12 actuation within a tight-fitting space.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pliers actuation facilitation assembly configured to assist a person in opening a pair of pliers, the assembly being removably attachable to the pliers, the assembly comprising:

a coupler configured to be removably coupled to a grip of a pair of pliers, the coupler being positionable between a free end of the grip and a pivot of the pliers, the coupler including a receiver positioned laterally away from an exterior lateral surface of the grip;

an auxiliary handle being positioned in the receiver such that the auxiliary handle is positioned adjacent to the exterior lateral surface and extends away from the pivot, wherein a finger space is defined between the auxiliary handle and the grip, the auxiliary handle comprising a plate being elongated and having a first end, a second end, a first lateral side, a second lateral side, an upper edge and a lower edge, the coupler engaging the plate adjacent to the first end such that the first lateral side faces the exterior lateral surface;

wherein the coupler includes a saddle having a base and a pair of panels being attached to the base and extending away from the base in same direction with respect to each other, a receiving space being defined between the panels, wherein the base is abuttable against an interior surface of the grip such that the panels extend laterally away from the exterior lateral surface of the grip, the auxiliary handle being positioned between the panels;

wherein the coupler further includes a stop having a top side and a bottom side, the stop being positioned in the receiving space and being abutted against the auxiliary handle, and a fastener extending through the panels and the stop to retain the stop in the receiving space.

2. The pliers actuation facilitation assembly according to claim 1, wherein the first lateral side has a first bend and a second bend positioned therein, the first bend being nearer to the first end than the second end, the first bend forming a convex curve in the first lateral side, the second bend forming a concave curve in the first lateral side.

3. The pliers actuation facilitation assembly according to claim 2, wherein a radius of the first bend being smaller than a radius of the second bend.

4. The pliers actuation facilitation assembly according to claim 1, wherein the upper and lower edges each having a notch therein positioned adjacent to the first end, each of the notches receiving one of the panels.

5. The pliers actuation facilitation assembly according to claim 4, wherein each of the top and bottom sides having slots therein, each of the slots receiving one of the panels.

6. The pliers actuation facilitation assembly according to claim 4, wherein the first lateral side has a first bend and a second bend positioned therein, the first bend being nearer to the first end than the second end, the first bend forming a convex curve in the first lateral side, the second bend forming a concave curve in the first lateral side.

7. The pliers actuation facilitation assembly according to claim 6, wherein a radius of the first bend being smaller than a radius of the second bend.

8. The pliers actuation facilitation assembly according to claim 1, wherein each of the top and bottom sides having slots therein, each of the slots receiving one of the panels.

* * * * *